US005769538A

United States Patent [19]

Sherman et al.

[11] Patent Number: 5,769,538

[45] Date of Patent: Jun. 23, 1998

[54] MIXER HAVING MEANS FOR PERIODICALLY MECHANICALLY STRIKING LIQUID-CONTAINING TUBES TO INDUCE MOTION OF THE TUBES

[76] Inventors: Michael Sherman, 581 Saw Mill Brook Rd., Newton, Mass. 02159; Yury Sherman, 511 Beech St., Roslindale, Mass. 02131; Katerina Sherman, 85 Strathmore Rd. #43, Brighton, Mass. 02146

[21] Appl. No.: 671,211

[22] Filed: Jun. 27, 1996

[51] Int. Cl.[6] ..... B01F 13/00

[52] U.S. Cl. ..... 366/198

[58] Field of Search ..... 366/108, 197, 366/198, 208, 209, 219, 315, 317, 349

[56] References Cited

U.S. PATENT DOCUMENTS

| | | | |
|---|---|---|---|
| 3,819,158 | 6/1974 | Sharpe et al. | 366/349 |
| 4,118,801 | 10/1978 | Kraft et al. | 366/208 X |
| 4,125,335 | 11/1978 | Blume et al. | 366/209 |
| 4,305,668 | 12/1981 | Bilbrey | 366/208 X |
| 4,555,183 | 11/1985 | Thomas | 366/208 |
| 4,747,693 | 5/1988 | Kahl | 366/219 X |

FOREIGN PATENT DOCUMENTS

| | | | |
|---|---|---|---|
| 1699574 | 12/1991 | U.S.S.R. | 366/209 |

*Primary Examiner*—Charles E. Cooley
*Attorney, Agent, or Firm*—John H. Grozier

[57] ABSTRACT

A mixer is intended for mixing substances, resuspending pellets and disintegrating living cells, such as yeast cells. The mixer includes a tube holder and an electric motor with striking attachment(s). The main part of the holder is rigid rings coaxial with and located subsequently along the motor shaft. Each ring has a number of holes the tubes sit in. Diameters of the holes are larger then diameters of the tubes, so that there are gaps between the tubes and the rigid rings. The attachment(s) of the motor is disks with blades, affixed to the motor shaft. When the motor shaft rotates the blades strike against the tubes. Struck tubes are repelled by the rigid ring (due to a gap between the tubes and rings), get a new strike from the blades and so on. As a result, the substance inside the tube receives a turbulent motion which provides mixing, resuspending and disintegrating effects.

8 Claims, 3 Drawing Sheets

MIXER HAVING MEANS FOR PERIODICALLY MECHANICALLY STRIKING LIQUID-CONTAINING TUBES TO INDUCE MOTION OF THE TUBES

BACKGROUND OF THE INVENTION

Mixing substances, resuspending pellets and disintegrating living cells, such as yeast cells, contained in tubes for laboratory experiments are usually made by vibration. According to the standard procedure, a tube with small amount of substance is placed into a special attachment of the vibrator and is vibrated. During the procedure a researcher holds the tube by hand which is also subjected to vibration, injurious and harsh for people. As a result, the researchers complain on pain and trembling in their hands after the procedure. As a requirement, in most cases the researchers have to make disintegrating works in cold rooms with discomfort temperature.

Vibrators, as a laboratory equipment, also have some drawbacks: they are heavy (9–10 pounds) and thus, hard for moving; they have relatively large dimensions which is of significant inconvenience for laboratories with limited space.

SUMMARY OF THE INVENTION

Accordingly, it is the object of the present invention to provide for automatically working mixer that is much lighter and smaller then existing models. The mixer can be used for mixing substances, resuspending pellets and disintegrating living cells, such as yeast cells, in multiple samples.

The mixer consists of the following main parts:

a base, a tube holder, an electric motor having striking attachment(s), and a cap.

The tube holder includes at least two rigid rings coaxial with and located subsequently along the motor's shaft. The rings are supported by a special structure (a cylinder affixed to the rings' outer periphery in the preferred embodiment). The rings have a number of registered holes the tubes sit in. Diameters of the holes are larger than diameters of the tubes, so that there is a gap between the tubes and the rigid rings. Inner edges of the holes are equidistance from an axis of the motor shaft.

The striking attachment of the motor is a disk with blades, affixed to the motor shaft. These blades provide strikes against the tubes when the motor shaft rotates. Struck tubes are repelled by the rigid rings (due to a gap between tube and ring at the place the tubes sit in the holes), get a new strike from the blades, are repelled by the rigid rings again and so on. As a result, the substance inside the tube receives a turbulent motion which provides mixing, resuspending and disintegrating effects.

By using the rings with holes of different diameters a plurality of tubes of various sizes can be treated simultaneously.

The cap is intended to prevent the tubes flying off the holder when the tubes are struck by the blades and to reduce a level of noise when the holder works.

DESCRIPTION OF THE PREFERRED EMBODIMENT

Figure 1:
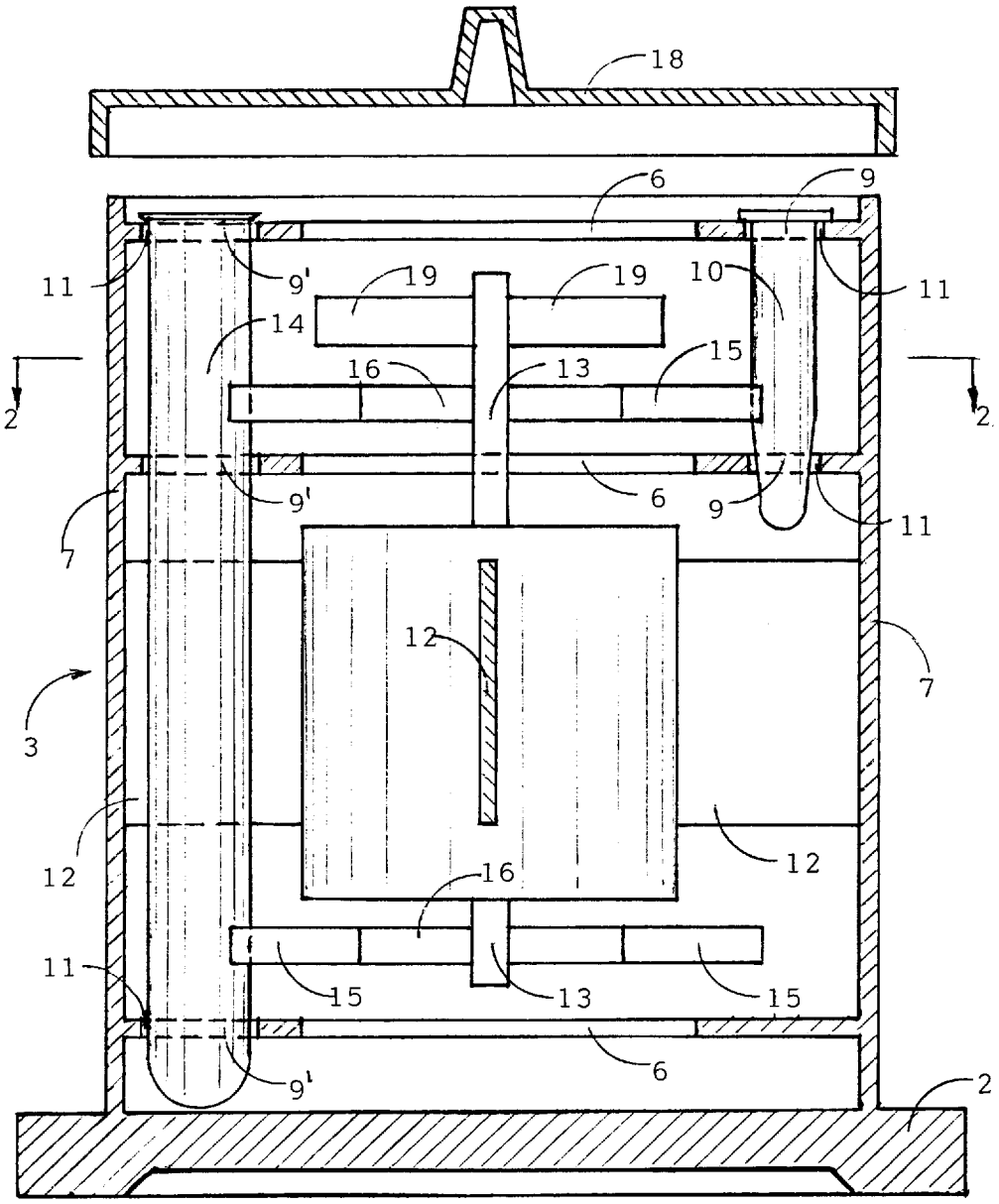
FIG. 1. is a cross-section of the mixer.

Referring to the drawing in more detail, in FIG. 1 a longitudinal cross-section of the mixer is shown. The mixer consists of a base 2, a tube holder generally indicated by the reference numeral 3, an electric motor 4 having striking attachments 5, and a cap 18.

The base 2 is intended to support the tube holder and tubes without a flange (FIG. 1).

Figure 2:
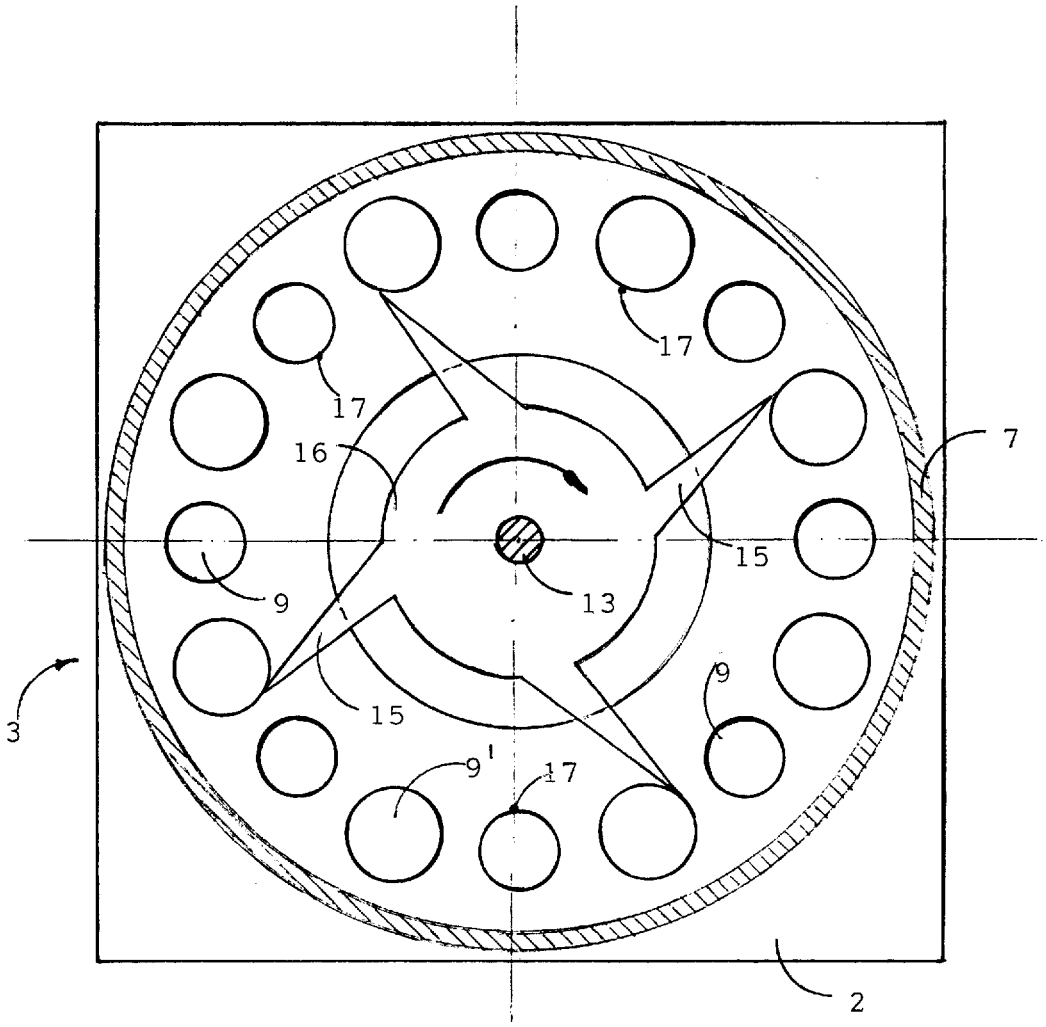
FIG. 2. is a plane view of the mixer in preferred embodiment taken along line "2—2" of FIG. 1.
Figure 3:
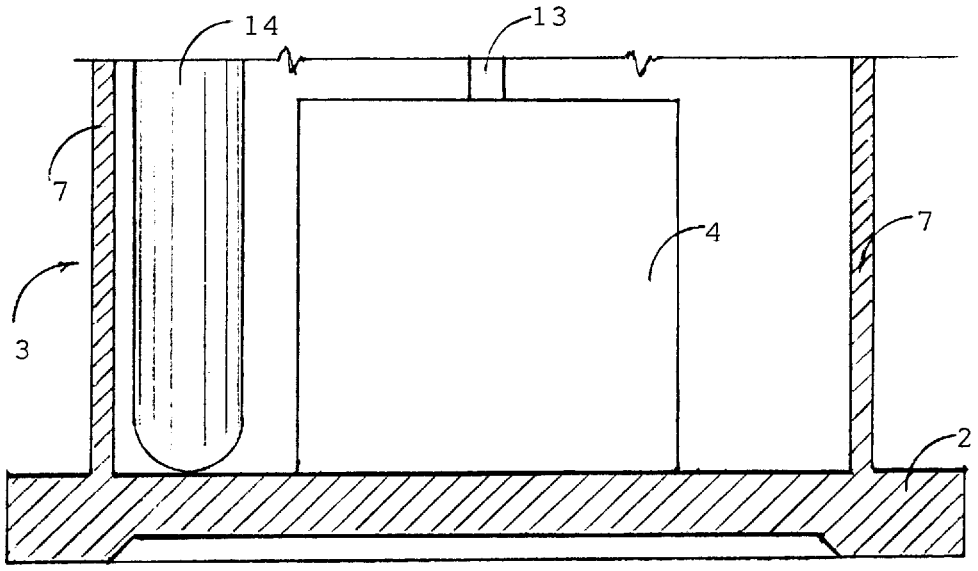
FIG. 3 is a fragmentary cross-section of the mixer according to another preferred embodiment.

The tube holder 3 includes vertically apart rigid rings 6 coaxial with an axis of the motor shaft 13. The rigid rings have registered holes 9 and 9' (FIG.2) the tubes sit in. Number of the holes in each ring is equal to a number of tubes which are treated simultaneously. As it is shown, each hole can be used for a tube of a particular diameter. Diameters of the holes 9 and 9' are larger than a diameter of the small tubes 10 and a diameter of the large tubes 14, accordingly, so that there are gaps 11 between the tubes 10 and 14 and the rigid rings 6. If the tubes have flanges, such as is the case with tubes 10, as in case of eppindorf tubes, the diameter of the holes 9 in the upper ring should be less than diameter of the tube's flange, so that the tubes rest on the upper ring. If the tubes don't have flanges, such as is the case with tubes 14, they are supported by the base 2. A position of the holes on each ring has to provide an equidistance of points, as at 17, of the holes (nearest to the motor shaft) from an axis of the shaft.

A number of the rings 6 is determined by a requirement that each tube have to sit in at least two rings: one at an upper end of the tube and one at its lower end. In preferred embodiment the tube holder 3 is intended for holding tubes of two different heights and diameters. Therefore, it includes three rigid rings 6. Evidently, that if the mixer is intended to treat tubes of equal height it should have two rings.

The rings are rigidly affixed at its outer periphery to a supporting structure. In the preferred embodiment it is a cylinder 7 removeably affixed to the base 2.

In preferred embodiment the electric motor 4 is located inside the holder 3 and is supported by brackets 12 of the supporting structure 7. The motor shaft is extended from the motor upward at about ½ inch above the ends of the small tubes 10 and downward at about 1 inch above the ends of the big tubes 14.

The striking attachment 5 is a disk 16 with a number of extended blades 15. The attachment is affixed to the motor shaft 13. A length of the blades 15 is slightly higher than the distance between axis of the motor shaft and points 17 of the holes in the rings (9 and 9'), so that the blades strike against the tubes during rotation of the motor shaft 13. In the preferred embodiment there are two striking attachments 5 which are located against lower ends of the tubes 10 and 14. Evidently, that if the mixer is intended to treat tubes of equal height the motor 4 can have only one striking attachment 5 and can be placed directly on the base 2. In this case the tube holder can be supported by the base or by the motor housing.

The cap 18 is intended to prevent flying off the tubes and to reduce level of noise when the mixer works. It should be placed after the tubes are installed.

In some cases, for example during disintegration of living cells, the substance in the tubes emit a lot of heat, and the tubes should be cooled. For this purpose fan blades 19 should be installed on the motor shaft. When the electric motor rotates the blades create the air flow inside the supporting structure of the mixer which activate heat transmission from the tubes to the surrounding air. The heat transmission process will be especially effective if the mixer works in a cold room.

When the motor rotates, the tubes struck by the blades are repelled by the rigid rings (due to a gap between tube and rigid ring), get a new strike from the blades, then are repelled by the rigid rings again, and so on. Due to strikes, the substance inside the tubes receives a turbulent motion which provides mixing, resuspending and disintegrating effects.

This invention is not limited to the details shown since various modifications and structural changes are possible without departing in any way from the spirit of the present invention. What is desired to be protected is set forth in particular in the appended claims.

What is claimed is:

1. A mixer for mixing substances, resuspending pellets and disintegrating living cells, including yeast cells, placed in tubes comprising: a base, a tube holder and an electric motor with at least one striking attachment;

said base supporting said tube holder;

said tube holder having a supporting structure and at least two rigid spaced apart rings rigidly attached to the supporting structure;

said rings having a number of registered holes the tubes can be supportingly placed in, the at least two rigid rings being located apart at a distance providing contact of each tube with at least two of the at least two rigid rings rings: one ring at the upper part of the tube and another ring at the lower part of the tube;

said holes having diameters larger than diameters of the tubes which are to be placed therein, so that there are gaps between the tubes and the holes, the holes being positioned on the rings so that the distances from the points nearest to the motor shaft, of each of the holes, to the axis of the motor shaft are equal;

said electric motor having an extended shaft with the at least one striking attachment affixed thereto, which extended shaft is located inside the tube holder, coaxial with the rings of the tube holder;

said at least one striking attachment including at least one blade extended from said shaft; and said at least one blade having a length which provides striking engagement with said tubes when the motor shaft rotates.

2. A mixer according to claim 1, wherein said base supports said electric motor.

3. A mixer according to claim 1, wherein said tube holder supports said electric motor.

4. A mixer according to claim 1, wherein said supporting structure of the tube holder is removeably affixed to said base.

5. A mixer according to claim 1, wherein diameters of said holes in an upper one of the at least two rigid rings are less than diameters of flanges formed around peripheral ends of the tubes to be placed therein, such that the tubes will be supported by lower surfaces of the flanges engaging an upper surface of the upper one of the at least two rigid rings.

6. A mixer according to claim 1, which has a cap for placing over and closing the tube holder, for preventing flying off of the tubes and reducing a level of noise when the mixer works.

7. A mixer for mixing substances disposed in at least one tube, comprising:

a housing;

restricting means through which said at least one tube passes, permitting limited transverse movement of said at least one tube, in a direction transverse to the major axis of said tube, when said at least one tube is subjected to transverse strikes, said restricting means including at least one ring having at least one hole defined therethrough, said at least one hole having a diameter greater than an outer diameter of said at least one tube; and striking means, generating said transverse strikes, disposed in said housing to periodically strike against said at least one tube to cause said at least one tube to move outwardly from an inward position to an outward position, said restricting means causing said at least one tube to return from said outward position to said inward position.

8. A mixer according to claim 7 wherein said striking means includes at least one blade attached to a shaft of an electric motor disposed within said housing.

* * * * *